US011570561B2

(12) United States Patent
Krull et al.

(10) Patent No.: US 11,570,561 B2
(45) Date of Patent: Jan. 31, 2023

(54) HEARING DEVICES AND METHODS OF MAKING THE SAME

(71) Applicant: Falcom A/S, Ballerup (DK)

(72) Inventors: Vidya Krull, Highland Park, IL (US); Andrew Dittberner, Antioch, IL (US)

(73) Assignee: Falcom A/S, Ballerup (DK)

( * ) Notice: Subject to any disclaimer, the term of this patent is extended or adjusted under 35 U.S.C. 154(b) by 0 days.

(21) Appl. No.: 16/213,985

(22) Filed: Dec. 7, 2018

(65) Prior Publication Data

US 2020/0186949 A1 Jun. 11, 2020

(51) Int. Cl.

| | |
|---|---|
| ***H04R 25/00*** | (2006.01) |
| ***H04R 1/10*** | (2006.01) |
| ***H04R 25/02*** | (2006.01) |

(52) U.S. Cl.

CPC ..... *H04R 25/65* (2013.01); *H04R 1/1016* (2013.01); *H04R 25/02* (2013.01); *H04R 2225/025* (2013.01)

(58) Field of Classification Search

CPC ..... H04R 25/65; H04R 25/60; H04R 25/652; H04R 25/658; H04R 1/1016; H04R 1/1058; H04R 2225/025; H04R 25/02; H04R 2225/023; H04R 2225/77; H04R 25/659; H04R 25/00

See application file for complete search history.

(56) References Cited

U.S. PATENT DOCUMENTS

| | | | | |
|---|---|---|---|---|
| 7,403,629 | B1 * | 7/2008 | Aceti | H04R 25/656 381/322 |
| 8,761,423 | B2 * | 6/2014 | Wagner | H04R 25/602 381/323 |
| 9,554,216 | B2 * | 1/2017 | Poulsen | H04R 25/60 |
| 2002/0085728 | A1 * | 7/2002 | Shennib | H04R 25/602 381/328 |
| 2004/0165742 | A1 * | 8/2004 | Shennib | H04R 25/456 381/328 |
| 2005/0190938 | A1 * | 9/2005 | Shennib | H04R 25/602 381/328 |
| 2006/0291682 | A1 * | 12/2006 | Urso | H04R 25/652 381/328 |
| 2009/0074220 | A1 * | 3/2009 | Shennib | H04R 25/02 381/325 |
| 2010/0092016 | A1 * | 4/2010 | Iwano | H04R 25/407 381/313 |
| 2011/0058697 | A1 * | 3/2011 | Shennib | H04R 25/654 381/314 |
| 2014/0010396 | A1 * | 1/2014 | Karamuk | H04R 25/60 381/328 |
| 2014/0270191 | A1 * | 9/2014 | Nikles | H04R 25/554 381/23.1 |

(Continued)

*Primary Examiner* — Angelica M McKinney

(74) *Attorney, Agent, or Firm* — Vista IP Law Group, LLP

(57) ABSTRACT

A hearing device includes: an earpiece having a first end and a second end, wherein the first end of the earpiece is configured for insertion into an ear canal of a user, and wherein at least a part of the earpiece is configured for placement along a first bend of the ear canal; wherein the earpiece comprises a flexible member, at least a part of the flexible member located at the first end of the earpiece, wherein at least a part of the flexible member is configured for placement along a second bend of the ear canal located between the first bend and an eardrum.

34 Claims, 6 Drawing Sheets

(56) References Cited

U.S. PATENT DOCUMENTS

| | | | | |
|---|---|---|---|---|
| 2015/0055809 | A1* | 2/2015 | Rasmussen | H04R 1/1058<br>381/329 |
| 2015/0289061 | A1* | 10/2015 | Rasmussen | H04R 25/02<br>381/329 |
| 2016/0309266 | A1* | 10/2016 | Olsen | H04R 25/652 |
| 2017/0099553 | A1* | 4/2017 | Sacha | H04R 25/652 |
| 2018/0167752 | A1* | 6/2018 | Olsen | H04R 25/656 |
| 2019/0348041 | A1* | 11/2019 | Celia | G06F 40/284 |
| 2020/0029161 | A1* | 1/2020 | Thumm | H04R 25/659 |

* cited by examiner

HEARING DEVICES AND METHODS OF MAKING THE SAME

The present disclosure relates to hearing devices, such as hearing aids, and methods of making the same.

BACKGROUND

Comfort plays a major role in the acceptance of hearing technology. For instance, receiver-in-the-ear (RIE) devices have a standard (non-customized) size dome type (e.g., open, closed, tulip, etc.) that often hangs loosely in the canal and rubs against it; leading to poor fit, comfort, and itchiness. Furthermore, inappropriate dome size, shape, and design, as well as improperly selected dome configuration or dome-and-cable configuration for a user may aggravate the comfort problem.

Sometimes, a custom solution may be provided to achieve a better fit. This may be in the form of an earmold, or a shell in a custom device. However, despite customization, poor fit may still occur due to (1) the earmold or shell slipping out of the greasy cartilaginous portion of the ear canal, which has cerumen and sweat glands, and/or (2) ear canal dynamics between the first and the second bend of the ear canal, as well as in the concha.

In addition, ear canal dynamics, caused by jaw, head, and neck movements, may affect the fit and comfort for both custom and non-custom hearing devices.

Also, for the case of the receiver-in-the-ear (RIE) devices, improper cable length often leads to discomfort and poor directional performance by either tugging on the behind-the-ear (BTE) unit, or by being too mobile and loose, thereby misaligning the BTE microphones from their intended operational positions.

SUMMARY

It would be desirable to provide a hearing device that can address different comfort issues. It would also be desirable to provide a hearing device that can be inserted deeply into the ear canal while achieving a better fit and comfort. Such a hearing device may achieve fewer slit leaks, reduced occlusion effect, and/or reduced feedback.

A hearing device includes: an earpiece having a first end and a second end, wherein the first end of the earpiece is configured for insertion into an ear canal of a user, and wherein at least a part of the earpiece is configured for placement along a first bend of the ear canal; wherein the earpiece comprises a flexible member, at least a part of the flexible member located at the first end of the earpiece, wherein at least a part of the flexible member is configured for placement along a second bend of the ear canal located between the first bend and an eardrum.

Optionally, the flexible member is elastically deformable so that the flexible member can conform with a shape of the ear canal when the earpiece is inserted into the ear canal.

Optionally, the flexible member has a customized shape that corresponds with a shape of the ear canal at the second bend.

Optionally, the flexible member is configured to provide an anchoring force that assists in preventing the earpiece from slipping out of the ear canal.

Optionally, the flexible member has a length that spans at least the second ear canal bend and a cartilage-bone junction (CBJ).

Optionally, the flexible member has a portion that is between the first bend and the second bend when the earpiece is inserted into the ear canal.

Optionally, the flexible member comprises foam, and a passage in the foam, wherein the passage is configured to acoustically couple to a receiver (output transducer) of the hearing device.

Optionally, the hearing device further includes the receiver.

Optionally, the flexible member has a shape memory characteristic.

Optionally, the earpiece further comprises a housing, and a receiver located in the housing, and wherein the flexible member is medial with respect to the housing.

Optionally, the hearing device further includes a sleeve surrounding the flexible member.

Optionally, the earpiece is configured to accommodate a part of the sound tube.

Optionally, the earpiece comprises a dome.

Optionally, the dome is customized.

Optionally, the flexible member comprises a 3D or 4D printed material.

Optionally, the flexible member is configured to change shape or elasticity in response to temperature, light or electricity.

Optionally, the flexible member has a length that is customized.

Optionally, the hearing device further includes an elongated member connected to the earpiece.

Optionally, the elongated member has a customized length.

A method of making a hearing device includes: identifying a first bend of an ear canal of a user; identifying a second bend of the ear canal of the user, wherein the second bend is located between the first bend and an eardrum; and making an earpiece having a flexible member based at least on the identified second bend.

Optionally, the method further includes identifying a cartilage-bone junction (CBJ) of the user, wherein the earpiece is made also based on the identified CBJ of the user.

Optionally, the CBJ is identified based on scanned data or earmold impression.

Optionally, the CBJ is identified based on skin thickness.

Optionally, the act of making the earpiece comprises performing 3D printing.

Optionally, the earpiece is made to include a cavity configured to accommodate a component of the hearing device.

Optionally, component comprises a housing or a part of a sound tube.

Optionally, the second bend is identified based on scanned data or earmold impression.

Optionally, the method further includes making an elongated member for coupling with the earpiece, wherein the elongated member has a length that is customized.

Optionally, the earpiece comprises a customized dome.

Other features and advantages will be described in the detailed description.

BRIEF DESCRIPTION OF THE DRAWINGS

The above and other features and advantages will become readily apparent to those skilled in the art by the following detailed description of exemplary embodiments thereof with reference to the attached drawings, in which.

DETAILED DESCRIPTION

Figure 1:
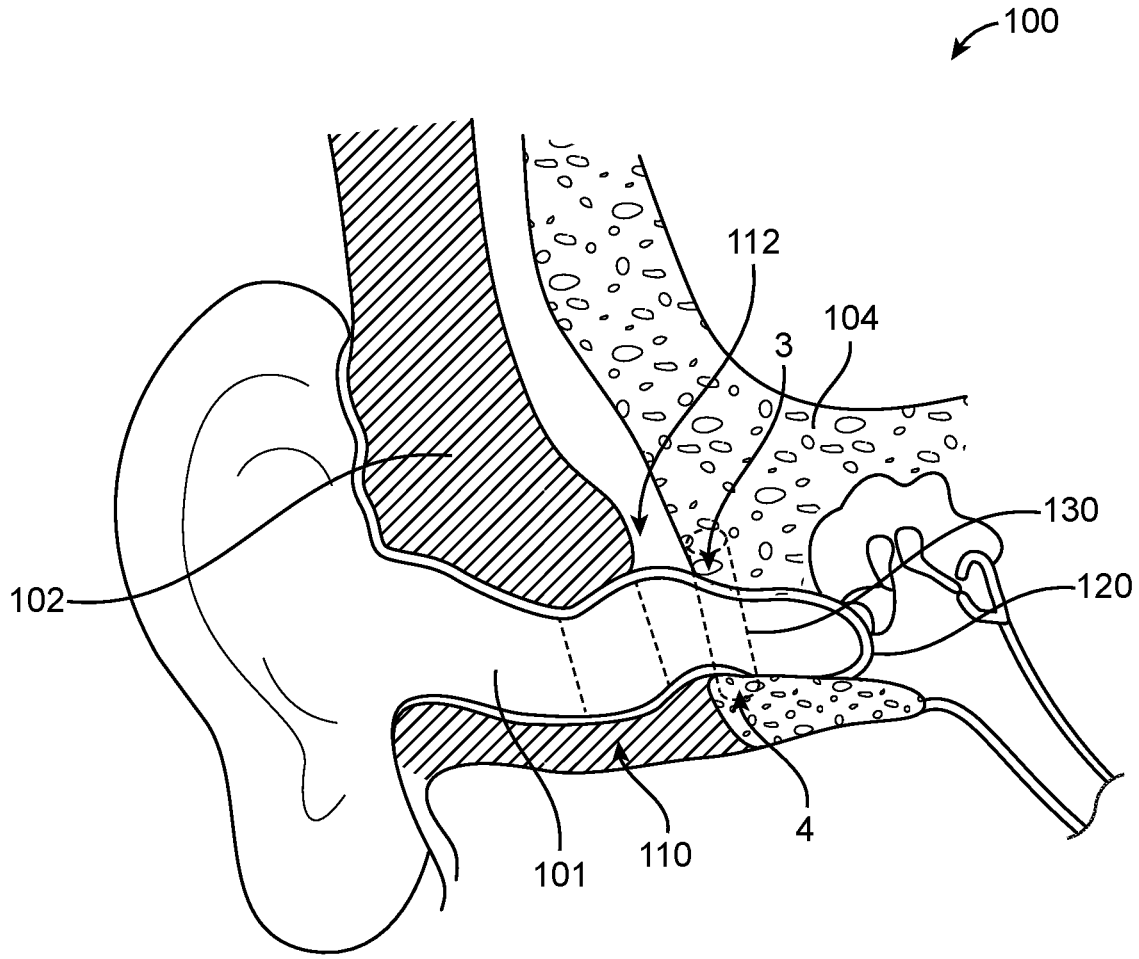
FIG. 1 illustrates the anatomy of a human outer ear.

Various exemplary embodiments and details are described hereinafter, with reference to the figures when relevant. It should be noted that the figures may or may not be drawn to scale and that elements of similar structures or functions are represented by like reference numerals throughout the figures. It should also be noted that the figures are only intended to facilitate the description of the embodiments. They are not intended as an exhaustive description of the invention or as a limitation on the scope of the invention. In addition, an illustrated embodiment needs not have all the aspects or advantages shown. An aspect or an advantage described in conjunction with a particular embodiment is not necessarily limited to that embodiment and can be practiced in any other embodiments even if not so illustrated, or if not so explicitly described.

A hearing device comprising an earpiece for insertion into an ear canal is described herein. The earpiece has a housing containing a receiver (output transducer), and a flexible member coupled to the housing. In some embodiments, the earpiece may further include a microphone. The housing is configured for placement along a first bend of an ear canal, and the flexible member is configured for placement along a second bend of the ear canal. The flexible member is configured to provide some anchoring force to assist preventing the housing from slipping out of the ear canal. In some cases, the flexible member may extend to a cartilage-bone junction (CBJ) next to the eardrum. Such deep insertion may improve fit of the hearing device, reduce occlusion effect, and/or may reduce feedback. The flexible member may include at least a portion that is made from soft material so that when the portion is placed at the CBJ, the user of the hearing device will find it comfortable to use the hearing device despite the increased sensitivity at the CBJ. The hearing device (e.g., the flexible member) may have a shape that is customized to fit the individual user. Alternatively, the hearing device may have a non-customized shape. In other embodiments, the earpiece may not include a receiver, and may instead be configured to couple to a sound tube. In further embodiments, the earpiece may comprise a dome, such as a customized dome. Methods of making the hearing device are also described herein.

The hearing device may be a hearing aid or a component (e.g., an earpiece) of a hearing aid. By means of non-limiting examples, the hearing aid may be a behind-the-ear (BTE) hearing aid, an in-the-ear (ITE) hearing aid, a completely-in-canal (CIC) hearing aid, an in-the-canal (ITC) hearing aid, or a receiver-in-the-ear (RITE) (also sometimes called a receiver-in-canal (RIC)) hearing aid. In some embodiments the hearing device may be bilaterally fit (one hearing aid in each ear of the user). The bilateral hearing aids may comprise a first earpiece and a second earpiece, wherein the first earpiece and/or the second earpiece is an earpiece as disclosed herein. Also, in some embodiments, the hearing device may be an Over-The-Counter (OTC) hearing aid that may be obtained without a prescription. The OTC hearing aid may be an ITE hearing aid, an ITC hearing aid, a CIC hearing aid, a BTE hearing aid, a RIC hearing aid, or a binaural hearing aid.

FIG. 1 illustrates an anatomy of a human outer ear 100 and its surrounding anatomical features. The outer ear comprises an ear canal 101 surrounded by cartilage region 102 and bony region 104. The ear canal 101 has a first bend 110 and a second bend 112, and transmits sound to an eardrum 120. The CBJ 130 is the region in which the cartilage region 102 transitions to the bony region 104. In most individuals, the CBJ 130 may be located medial to the second bend 112. In other individuals, the CBJ 130 may be located lateral to the second bend 112. In some cases, the CBJ 130 may be located using optical coherence tomography (OCT). The CBJ 130 may be identified using measurements of the relative thickness of skin in the cartilage and bony areas. In other cases, the CBJ 130 may be located using imaging techniques based on measurements of bony shelf surrounding the ear canal, relative to other landmarks.

Figure 2:
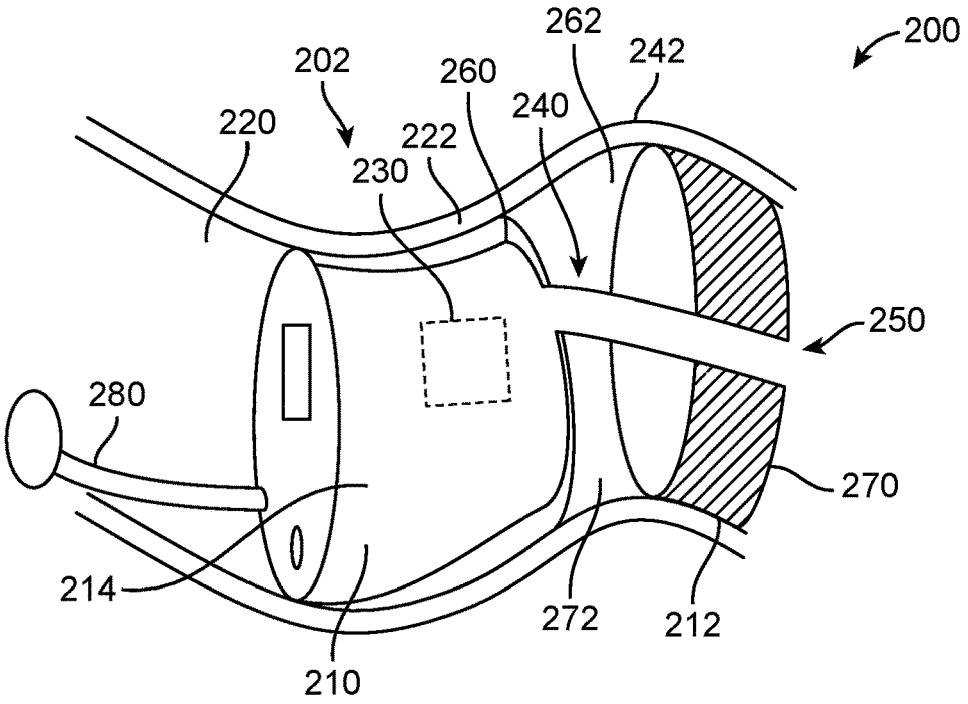
FIG. 2 illustrates a hearing device.

FIG. 2 illustrates a hearing device 200 in accordance with some embodiments. The hearing device 200 includes an earpiece 202. The earpiece 202 has a first end 212 and a second end 214. The first end 212 of the earpiece 202 is configured for insertion into an ear canal 220 of a user. At least a part of the earpiece 202 is configured for placement along a first ear canal bend 222 of the ear canal 220. As shown in the figure, the earpiece 202 of the hearing device 200 also includes a flexible member 240, wherein at least a portion of the flexible member 240 is at the first end 212 of the earpiece 202, wherein at least a part of the flexible member 240 is configured for placement along a second ear canal bend 242 of the ear canal 220.

In the illustrated embodiments, the earpiece 202 is coupled to a housing 210. The housing 210 accommodates a receiver 230. In some cases, the housing 210 and/or the receiver 230 may be considered to be component(s) of the earpiece 202 and the hearing device 200. In other cases, the hearing device 200 and the earpiece 202 may not include the housing 210 and the receiver 230.

In some embodiments, the earpiece housing 210 may have a customized configuration (e.g., size and/or shape) tailored for a specific user. In other embodiments, the earpiece housing 210 may have a standard configuration.

As used in this specification, the term "flexible member" refers to a member having a flexibility that is higher than that of another component (e.g., the housing 210) of the earpiece. Also, in some cases, the flexibility of the flexible member 240 may have a value that is sufficiently high for allowing the flexible member 240 to deform to conform to the curvature of the ear canal 220 as the flexible member 240 is inserted into the ear canal 220.

In some embodiments, the flexible member 240 is elastically deformable so that the flexible member 240 can deform to conform with a shape of the ear canal 220 when the earpiece 202 is inserted into the ear canal 220. Also, in some embodiments, the flexible member 240 may have an asymmetrical shape like that shown in FIG. 2. In particular, the flexible member 240 may have a shape that corresponds with a shape of the second bend 242 even when the flexible member 240 is in a relaxed configuration when the earpiece 202 is not inserted into the ear canal 220.

In some embodiments, the flexible member 240 may have a customized shape that corresponds with a shape of the ear canal of a specific user at the second ear canal bend. In other embodiments, the flexible member 240 may have a non-customized shape. In such cases, the flexible member 240 may be made in different sizes and shapes to fit different groups of users, such as users in different age groups, different sexes, and/or different ethnicities.

In some embodiments, the flexible member 240 may be configured to provide an anchoring force that assists in preventing the earpiece 202 from slipping out of the ear canal 220. The anchoring force may be due to frictional contact between the flexible member 240 and wall of ear canal, and/or a curvature of the flexible member 240 along a longitudinal length of the earpiece 202 (i.e., which corresponds with a length of the ear canal 220).

In some embodiments, the flexible member 240 has a portion that extends at least from the second ear canal bend 242 to a location that is in the CBJ. In other embodiments, the flexible member 240 has a portion that extends at least from the second ear canal bend 242 to a location that is outside the CBJ (e.g., lateral to the CBJ in the cartilage region 102, or medial to the CBJ in the bony region 104, where the term "lateral" and the term "medial" are with respect to the sagittal plane that transects the human body).

Figure 3:
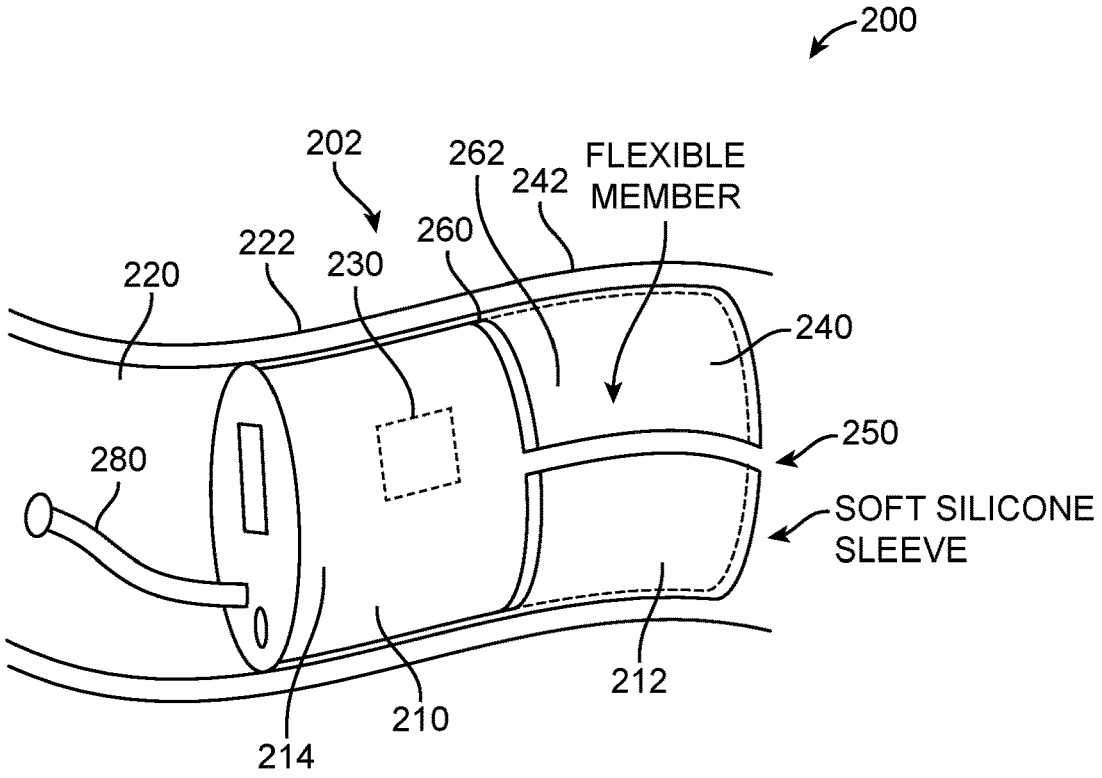
FIG. 3 illustrates another hearing device.

In the illustrated embodiments, the earpiece 202 also has a sleeve 260 configured to accommodate at least a part (e.g., an entirety) of the housing 210. In the illustrated embodiments, the sleeve 260 may be a part of the flexible member 240 so that the sleeve 260 and the portion 262 of the flexible member 240 proximal (medial) to the housing 210 are integrally formed together using the same material. In other embodiments, the sleeve 260 and the portion 262 may be integrally formed using different materials, or may be separately formed and are then coupled together. The sleeve 260 may be made from silicone or other materials. In one implementation, the sleeve 260 may extend medially with respect to the housing 210 (FIG. 3). In such cases, the sleeve 260 also surrounds the flexible member 240. The flexible member 240 in such cases may be fixedly coupled to an inner part of the sleeve 260, or may be formed integrally with the sleeve 260.

Figure 4:
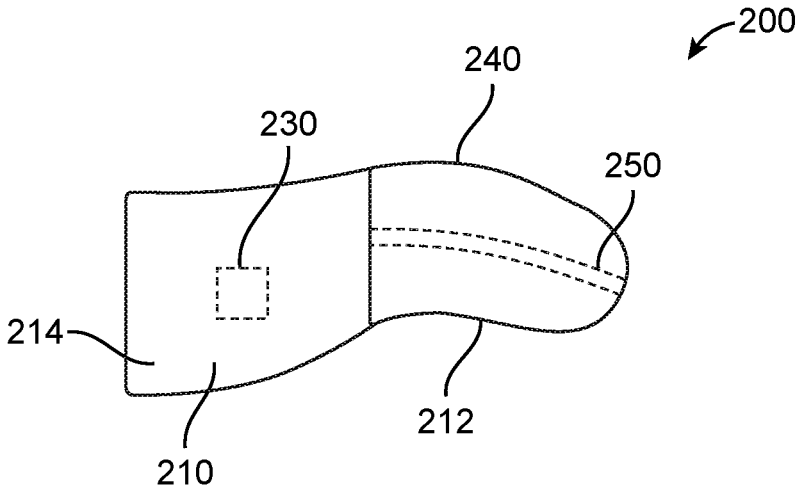
FIG. 4 illustrates another hearing device.

Also, in some embodiments, the entire flexible member 240 and the housing 210 may be serially coupled along a length of the ear canal 220 (FIG. 4). In such cases, the hearing device 200 does not include a sleeve extending from the flexible member 240 for accommodating the housing 210. The flexible member 240 may be fixedly secured to the housing 210, or may be detachably coupled to the housing 210 (e.g., via a snap fit, a connector, a screw, etc.).

The flexible member 240 may be made from foam, such as memory foam, or other materials, such as polymer, gel, silicone, etc. In some cases, the flexible member 240 may have a shape memory characteristic. In some embodiments, the flexible member 240 may be configured to change shape and/or elasticity in response to temperature, light or electricity. In one implementation, the flexible member 240 may be made from a shape memory material (e.g., shape memory alloy) that changes shape and/or elasticity in response to temperature, light, or electricity. The use of shape memory material is advantageous because it may allow the audiologist or dispenser to make "in-house" personalized adjustments to the angle or shape of the flexible member 240. Such may be needed to account for individual ear canal dynamics due to jaw or head motion, thereby resulting in improved fit.

Also, in some embodiments, the entire flexible member 240 may be made from the same material. In other embodiments, different parts of the flexible member 240 may be made from different materials with different properties (e.g., elasticities, stiffness, etc.). For example, a first part 270 of the flexible member 240 that is closer to the eardrum may be made from a first material, and a second part 272 of the flexible member 240 that is further from the eardrum may be made from a second material stiffer than the first material. In some embodiments, the first part 270 may be made from a first foam, and the second part 272 may be made from a second foam (or from another material) that is stiffer than the first foam. The softer first foam in the first part 270 of the flexible member 240 allows the first part to be positioned in the CBJ or even in the bony region 104 of the ear canal 220. Alternatively, both the first and second parts 270, 272 may be made from the same material, e.g., same foam. As another example, a circumferential part of the flexible member 240 may be made from a first material while an inner part of the flexible member 240 may be made from a second material that is different from (e.g., stiffer or softer than) the first material.

As shown in FIG. 2, the flexible member 240 has a passage 250 that is acoustically coupled to the receiver 230. During use, the passage 250 allows sound from the receiver 230 to travel through to reach the eardrum 120 (shown in FIG. 1).

In some embodiments, the flexible member 240 may be fabricated using 3D printing technology. In such cases, the flexible member 240 may comprise one or more 3D printing materials. In some embodiments, the entire flexible member 240 may be made from a single printing material. In other embodiments, different portions of the flexible member 240 may be made from different printing materials with different properties. For example a circumferential part of the flexible member 240 may be made from a first material while an inner part of the flexible member 240 may be made from a second material that is different from (e.g., stiffer or softer than) the first material. As another example, a first part 270 of the flexible member 240 that is closer to the eardrum may be made from a first material, and a second part 272 of the flexible member 240 that is further from the eardrum may be made from a second material stiffer than the first material. In the illustrated embodiments, the 3D printing material is biocompatible. Also in some cases, the 3D printing material may be configured to change shape or elasticity in response to temperature, light or electricity.

In some embodiments, one or more characteristics of the flexible member 240 may be customized to specific user. For example, in some embodiments, the flexible member 240 may have a length (e.g., a longitudinal length along a direction of the ear canal 220) that is customized. As another example, the flexible member 240 may have a shape, dimension, and/or curvature that is customized to correspond with a shape of the anatomy of a specific user.

Customization of the shape, dimension, and/or curvature of the flexible member 240 is advantageous because it provides a more secure fit for the user. In some embodiments, the position and orientation of the passage 250 may also be customizable, which allows a sound emitting position and direction to be adjusted. In addition, in some cases, the length, shape, and size of the cross section of the passage 250 may also be customizable. Also, in some embodiments, the position of the receiver 230 relative to the housing 210 may also be customizable. This allows the receiver 230 to be centered in the ear canal opening.

In some embodiments, the same passage 250 in the flexible member 240 may also serve to receive feedback from within the ear canal 220, and to transmit the feedback signal to a microphone in the earpiece 202. In other embodiments, the earpiece 202 may have another passage configured to receive feedback signal from within the ear canal 220, and to transmit the feedback signal to a microphone in the earpiece 202. Also, in some embodiments, the passage for transmitting feedback signal may be customizable (e.g., the position, orientation, length, shape, cross-sectional size, or any combination of the foregoing, of such passage may be customized for a particular user).

In the illustrated embodiments, the hearing device 200 is a stand-alone earpiece 202 with the receiver 230. In such cases, the earpiece 202 also includes a battery compartment (not shown) for powering the hearing device 200 (e.g., the receiver, a hearing loss processing unit configured to perform hearing loss compensation for the user, etc.). The earpiece 202 may also optionally include a retrieval line 280 for allowing a user to remove the earpiece 202 from the ear canal 220 by pulling on the retrieval line 280.

In other embodiments, the earpiece 202 may be configured to receive signals from an external component. In such cases, the hearing device 200 may include such external component. For example, in some embodiments, the hearing device 200 may include a behind-the-ear (BTE) component configured to provide signals to the earpiece 202. In such cases, the hearing device 200 may also include an elongated member connected to the earpiece 202. The elongated member may have a customized length or a standard length. For example, the elongated member may have a first segment extending from the earpiece 202 to an outer part of an ear canal, and a second segment extending from the first segment to a behind-the-ear component. The first segment and/or the second segment of the elongated member may have a customized length.

Figure 5:
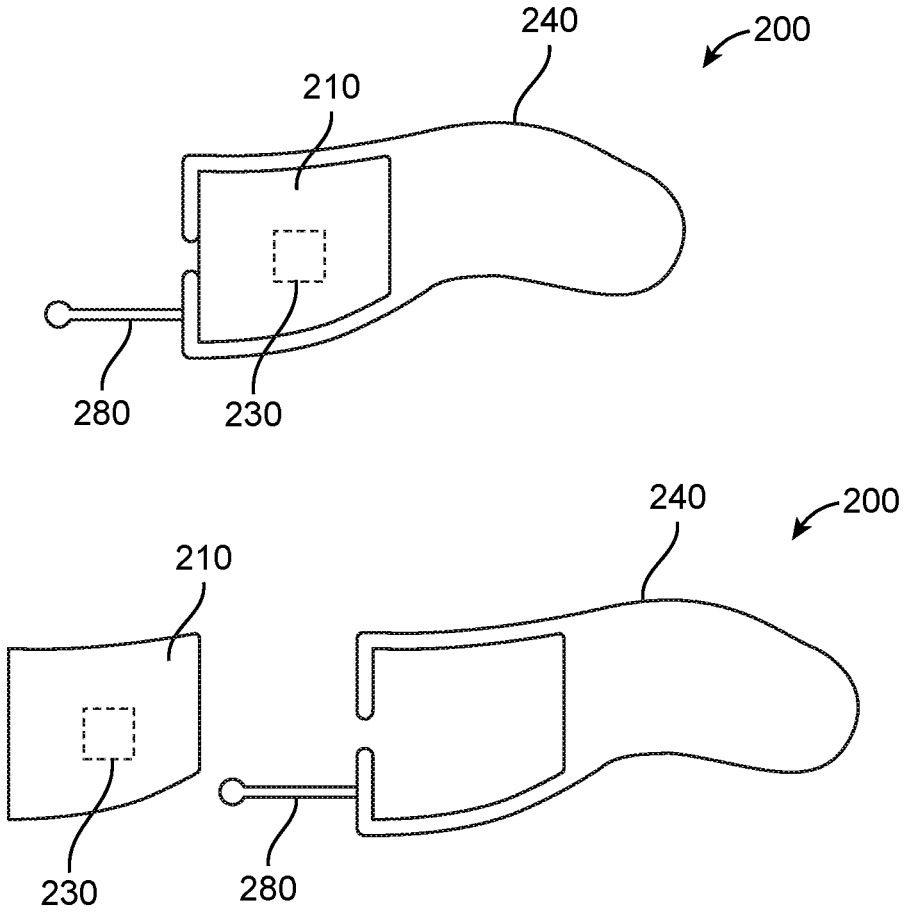
FIG. 5 illustrates another hearing device.

In one or more embodiments described herein, the flexible member 240 may be detachably coupled to the rest of the earpiece 202. FIG. 5 illustrates another hearing device 200, particularly showing the flexible member 240 being detachably coupled to the rest of the earpiece 202. As shown in the figure, the flexible member 240 is part of, or is integrally formed with, a sleeve. The sleeve has a cavity configured to accommodate the earpiece housing 210. To remove the flexible member 240, the sleeve will need to be decoupled from the earpiece housing 210. This configuration is advantageous because it may prevent accidental detachment of the flexible member 240 while removing the earpiece 202 from the ear canal 220 (which would result in the flexible member 240 remaining in the ear canal 220). In the case of a custom device (which may be an ITE, ITC, etc.), the retrieval line 280 may be fixedly attached to the sleeve. This also prevents accidental detachment of the flexible member 240 from the housing 210 while the retrieval line 280 is being pulled to remove the earpiece from the ear canal. In other embodiments, the flexible member 240 may be detachably coupled to the housing 210 via other connection mechanism, such as a clip, a connector, etc.

In some embodiments, the flexible member 240 may have a length so that it extends to a location that is lateral to the CBJ. In other embodiments, the flexible member 240 may have a length so that it extends to a location that is at the CBJ. In further embodiments, the flexible member 240 may have a length so that it extends to a location that is beyond the CBJ and in the bony region. Also, in other embodiments, the flexible member 240 may extend to a location that is lateral to a second bend of the ear canal, or the second bend of the ear canal, or to a location that is medial to the second bend of the ear canal.

In some embodiments, the flexible member 240 may have a portion extending from a curvature (corresponding to the second ear canal bend) to a tip, with the portion having a length that is between 5 mm and 8 mm.

Embodiments of the hearing device 200 described herein are advantageous because they may allow a deeper placement into the ear canal while providing comfort to the user. The deeper placement of the hearing device 200 reduces the space between the hearing device 200 and the eardrum, increases the gain provided, reduces the occlusion effect, reduces feedback, and improves the modulation of the user's own voice. In some cases, embodiments described herein provide flexible members (e.g., flexible member 240) that serve as extensions of hearing devices that allow the hearing devices to be placed deeper into the ear canal.

Also, the flexibility of the flexible member 240 is beneficial in that it allows for ear canal dynamics in the region between the first and second ear canal bend. For example, jaw movement of the user may induce relative movement between the first ear canal bend and the second ear canal bend. The flexibility of the flexible member 240 is sufficiently high to allow for such relative movement. In addition, the proximal end of the flexible member 240 is made from sufficiently soft material so that comfort is provided to the user even if the flexible member 240 is placed in the CBJ region or in the bony region. Also, the flexible member 240 provides a better and more secure fit, which will result in additional feedback reduction benefits and improved sound fidelity.

Figure 6:
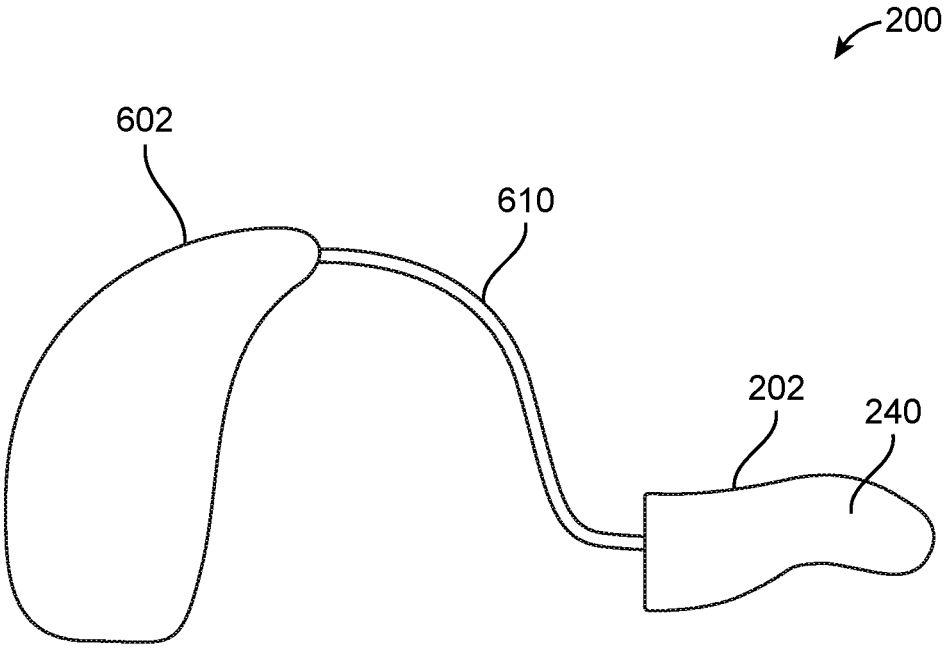
FIG. 6 illustrates another hearing device.

In the above embodiments, the hearing device 200 has been as a stand-alone hearing piece 202. Such hearing device 200 may be an ITE or an ITC hearing aid. As discussed, in other embodiments, the hearing device 200 may be a BTE-RIE hearing aid. For example, as shown in FIG. 6, the hearing device 200 may include a BTE component 602 configured to provide signal to the earpiece 202 via an elongated member 610. The elongated member 610 may be an electrical cable. In such cases, signals from the elongated member 610 are converted into sound by the receiver 230 in the earpiece 202, and the sound is outputted from the passage 250.

Alternatively, instead of a cable connecting between the BTE component 602 and the earpiece 202, the elongated member 610 may be a sound tube coupled between the BTE component 602 and the earpiece 202. In such cases, the earpiece 202 does not have the receiver 230. Instead, the sound tube conducts sound from the BTE component 602, and the sound is then outputted from the passage 250 of the earpiece 202. In such embodiments, the earpiece 202 has a cavity configured to accommodate at least a part of the sound tube. Thus, in any of the embodiments described herein, the earpiece 202 may not include the receiver 230.

Figure 7:
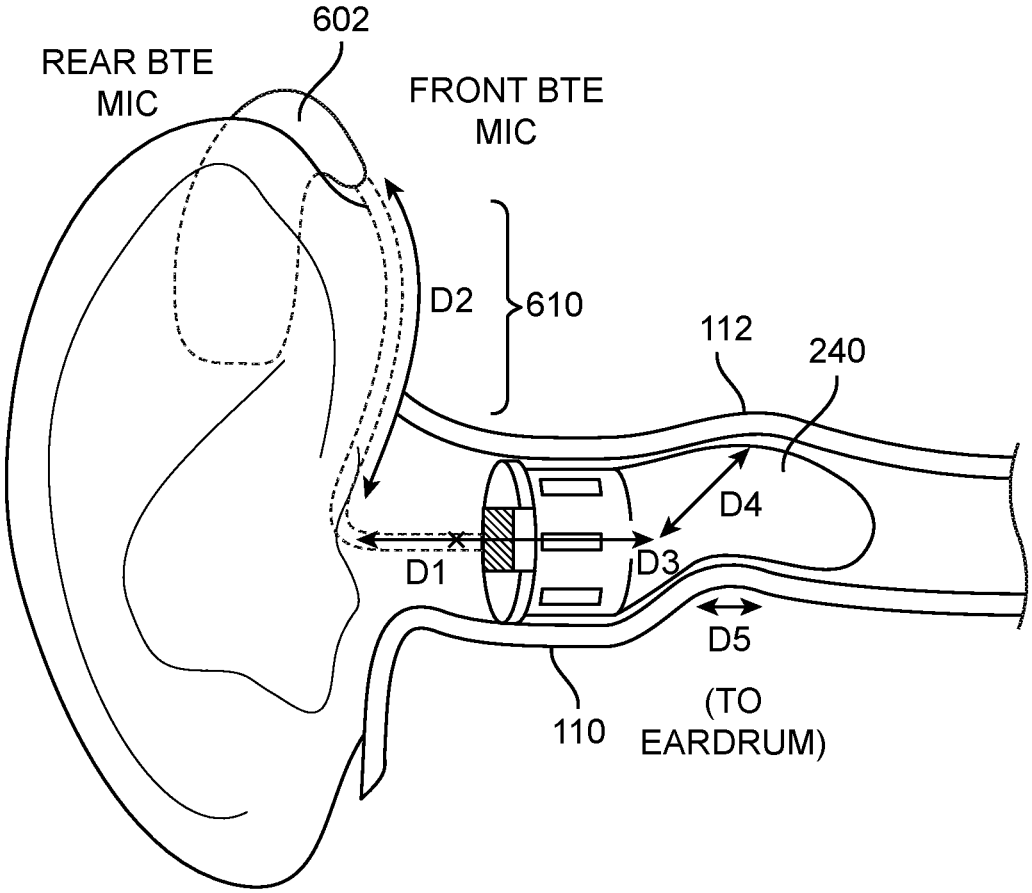
FIG. 7 illustrates customizable dimensions for a hearing device.

In some embodiments, the elongated member 610 may have a length that is customized for specific user. For example, as shown in FIG. 7, the elongated member 610 may have a first segment D1 that extends between the earpiece 202 and an outer part of the ear canal, and a second segment D2 that extends from the first segment to the BTE component. The first segment D1 and/or the second segment D2 may be customized to fit a particular user. In some embodiments, the customization of the elongated member 610 may be performed based on earmold impression, scanned data, images of user's ear, three-dimensional modelling of the user's ear, or any combination of the foregoing.

Also, in some embodiments, the length of the elongated member 610 may be based on a total length (e.g., measured along a longitudinal axis of the ear canal 220) of the earpiece 202, a length (D3) of the housing 210, a dome dimension, a length (D4) of the flexible member 240 measured from end of the housing 210 to the second ear canal bend 112, or a combination of the foregoing.

Customizing the length of the elongated member 610 may be advantageous. If the length of the elongated member 610 is too short then the earpiece 202 will not fit properly into the ear canal 220, and the longitudinal axis of the earpiece 202 will not be parallel to the longitudinal axis of the ear canal 220 and may cause reduced comfort for the user. If the length of the elongated member 610 is too long, the elongated member 610 may stick out from the side of the ear and become visually displeasing for the user. Furthermore, if the elongated member 610 is too long, the BTE component may be improperly secured to the ear of the user, which may lead to that the BTE component may easily fall of the ear and be lost. Thus, it may be desirable for the personalisation to get a proper and fitting length for the elongated member 610 for the specific user.

It should be noted that the earpiece 202 is not limited to having the configuration shown in the illustrated embodiments, and that the earpiece 202 may have other configurations in other embodiments. For example, in some embodiments, the earpiece 202 may comprise a dome. The dome may be customized to fit a particular user. In some cases, the flexible member 240 may couple to an end of the dome. In other cases, the flexible member 240 may be integrally formed with the dome. In further cases, the flexible member 240 itself may implement the dome, and thus, the flexible member 240 itself may be the dome. The dome may be configured to couple to a sound tube, or to a RIE. Accordingly, in some embodiments, the earpiece itself may not include the earpiece housing 210.

Figure 8:
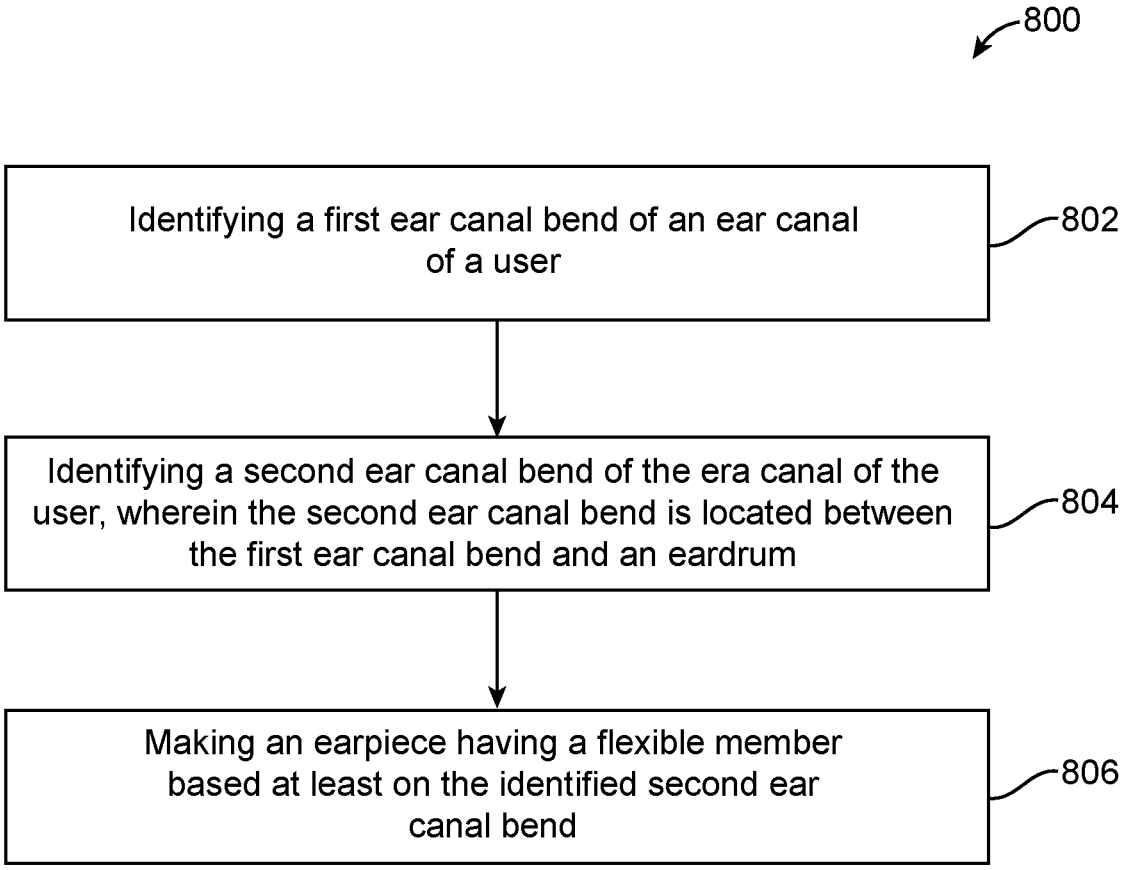
FIG. 8 illustrates a method for making a hearing device.

FIG. 8 illustrates a method 800 of making a hearing device. The method 800 includes: identifying a first ear canal bend of an ear canal of a user (item 802); identifying a second ear canal bend of the ear canal of the user, wherein the second ear canal bend is located between the first ear canal bend and an eardrum (item 804); and making an earpiece having a flexible member based at least on the identified second ear canal bend (item 806).

In some embodiments, the first ear canal bend and/or the second ear canal bend may be identified based on scanned data or earmold impression.

In some cases, the method 800 further includes identifying a cartilage-bone junction (CBJ) of the user, wherein the flexible member is made also based on the identified CBJ of the user. In some embodiments, a scanning may be performed to obtain scanned data of the ear canal, and the CBJ may be identified based on the scanned data. The scanning may be performed using a handheld scanning device with a probe that is configured to be inserted into the ear canal for scanning purpose. The handheld scanning device may emit light, ultrasound, or other forms of energy for scanning the ear canal. In one implementation, the handheld device may perform OCT to scan the ear canal. In some cases, OCT may provide high resolution images (1-10 μm) for skin with penetration depth of 1 mm. In other embodiments, an earmold impression of the ear canal may be made, and the CBJ may be identified based on the earmold impression. In further embodiments, the CBJ may be identified based on skin thickness. For example, a scan may identify a difference in skin thickness along different parts of the ear canal. Skin in the cartilaginous portion surrounding the ear canal may be an order of magnitude thicker than skin in the bony portion (e.g., 1 mm vs. 0.1 mm). Accordingly, in some embodiments, the scanning data may be analysed to identify skin thickness that is below a certain threshold (e.g., 0.3 mm), or a change in skin thickness along the ear canal that is more than a change threshold. Based on a result of such analysis, the CBJ may then be identified.

In other embodiments, the CBJ may be identified on the bases of absence of ceruminous glands in the bony portion. The bony portion of the ear canal is devoid of cerumen and sweat glands, and this feature may assist in the identification of the CBJ.

Furthermore, in some embodiments, the CBJ may be identified based on a location of the second ear canal bend. For example, if CBJ is on average 1 to 4 mm (e.g., 2 mm) from the second ear canal bend for a certain population group (e.g., adults), then the flexible member 240 may have a configuration in which it extends 1 to 4 mm (e.g., 2 mm) from the second ear canal bend. In some embodiments, the flexible member 240 may have an extent that is 1 to 4 mm medially from the second bend. In other embodiments, the flexible member 240 may have an extent that is 1 to 4 mm laterally from the second bend.

In some embodiments, in the method 800, the act of making the flexible member comprises performing 3D printing. The 3D printing material for the flexible member may be a biocompatible material. Also, in some cases, multiple 3D printing materials may be used. For example, the 3D printing may utilize a first 3D printing material with a first stiffness, and a second 3D printing material with a second stiffness that is less than the first stiffness. Thus, the second 3D printing material may be more flexible than the first 3D material. In some embodiments, the second 3D printing material may be used to make a proximal part (the part closer to an eardrum) of the flexible member, and the first 3D printing material may be used to make a distal part of the flexible member.

In some embodiments, the method 800 may further include securing the flexible member relative to a housing of an earpiece. For example, the flexible member may be secured to the housing via an adhesive and/or friction. In one implementation, the flexible member may be coupled to, or may include, a sleeve. In such cases, the sleeve may accommodate the housing of the earpiece.

In some embodiments, the method 800 is for making an earpiece that is a stand-alone device. In such cases, the method 800 may further include providing a microphone, a hearing loss processing unit, a receiver, a battery compartment in the earpiece, and a battery door for the earpiece. The hearing loss processing unit is configured to provide hearing loss compensation for a user. In some embodiments, the method 800 may further comprise providing an earpiece housing configured to accommodate the microphone, the hearing loss processing unit, the receiver, and the battery.

In other embodiments, the method 800 is for making a hearing device that includes an external component (e.g., a BTE component) for providing a signal to the earpiece. In such cases, the earpiece may not include any microphone and hearing loss processing unit. The method 800 may further include making an elongated member for coupling with the earpiece. The elongated member may be a cable configured to provide electrical signals to a receiver in the earpiece. Alternatively, the elongated member may be a sound tube configured to provide acoustic sound to the earpiece. The elongated member may have a customized length or a standard length. In some embodiments, an elongated member length between the earpiece and the BTE may be determined based on earmold impression, images of a user's ear, or a computerized model. Also, in some embodiments, the elongated member length may be determined based on D1 and/or D2 as shown in FIG. 7.

In further embodiments, the hearing device made by the method 800 may be an earpiece comprising a dome. The dome may have a customized shape and/or dimension. The flexible member may be integrally formed as a part of the dome, or may be coupled to the dome. The dome may be configured to couple to a sound tube, or to a RIE component.

The use of the terms "first", "second", etc. does not imply any particular order, but are included to identify individual elements. Moreover, the use of the terms "first", "second", etc. does not denote any order or importance, but rather the terms "first", "second", etc. are used to distinguish one element from another. Note that the words "first", "second", etc. are used here and elsewhere for labelling purposes only and are not intended to denote any specific spatial or temporal ordering.

Also, as used in this specification, the term "first end" of an earpiece may refer to a portion of the earpiece having a longitudinal length that is ⅓ of the entire length of the earpiece measured from a tip (corresponding with the first end) of the earpiece.

Although features have been shown and described, it will be understood that they are not intended to limit the claimed invention, and it will be made obvious to those skilled in the art that various changes and modifications may be made without departing from the spirit and scope of the claimed invention. The specification and drawings are, accordingly to be regarded in an illustrative rather than restrictive sense. The claimed invention is intended to cover all alternatives, modifications, and equivalents.

The invention claimed is:

1. A hearing device comprising:

an earpiece having a first end and a second end, wherein the first end of the earpiece is configured for insertion into an ear canal of a user, and wherein at least a part of the earpiece is configured for placement along a first bend of the ear canal;

wherein the earpiece comprises a flexible member, wherein at least a part of the flexible member is configured for placement along a second bend of the ear canal located between the first bend and an eardrum; and wherein the hearing device further comprises a receiver, wherein the flexible member has an end portion, and wherein the receiver is located between the end portion of the flexible member and the second end of the earpiece, and wherein the receiver is configured for placement outside a bony region associated with the ear canal, wherein the part of the flexible member that is configured for placement along the second bend of the ear canal is offset from the receiver in a medial direction, and wherein the part of the flexible member that is offset from the receiver in the medial direction has a first surface configured to abut a first side of an ear-canal-wall at different longitudinal locations along the first side of the ear-canal-wall, wherein the part of the flexible member also has a second surface configured to abut a second side of the ear-canal-wall at different longitudinal locations along the second side of the ear-canal-wall opposite from the first side of the ear-canal-wall, the second surface of the part of the flexible member being opposite from the first surface of the part of the flexible member; and wherein the flexible member has another part that is between the first bend and the second bend when the earpiece is inserted into the ear canal, and wherein the other part of the flexible member is configured to abut against the ear-canal-wall.

2. The hearing device of claim 1, wherein the flexible member is elastically deformable so that the flexible member can conform with a shape of the ear canal when the earpiece is inserted into the ear canal.

3. The hearing device of claim 1, wherein the flexible member has a customized shape that corresponds with a shape of the ear canal at the second bend.

4. The hearing device of claim 1, wherein the flexible member is configured to provide an anchoring force that assists in preventing the earpiece from slipping out of the ear canal.

5. The hearing device of claim 1, wherein the flexible member has a length that spans at least the second ear canal bend and a cartilage-bone junction (CBJ).

6. The hearing device of claim 1, wherein the flexible member comprises foam, and a passage in the foam, wherein the passage is configured to acoustically couple to the receiver of the hearing device.

7. The hearing device of claim 1, wherein the flexible member has a shape memory characteristic.

8. The hearing device of claim 1, further comprising a sleeve surrounding the flexible member.

9. The hearing device of claim 1, wherein the earpiece is configured to accommodate a part of a sound tube.

10. The hearing device of claim 1, wherein the flexible member comprises a 3D or 4D printed material.

11. The hearing device of claim 1, wherein the flexible member is configured to change shape or elasticity in response to temperature, light or electricity.

12. The hearing device of claim 1, wherein the flexible member has a length that is customized.

13. The hearing device of claim 1, further comprising an elongated member connected to the earpiece.

14. The hearing device of claim 13, wherein the elongated member has a customized length.

15. The hearing device of claim 1, wherein the first surface of the part of the flexible member is configured to abut the first side of the ear-canal-wall along an axis that is parallel to a longitudinal axis of the ear canal.

16. The hearing device of claim 1, wherein the part and the other part of the flexible member forms a continuous surface.

17. The hearing device of claim 1, wherein the part and the other part of the flexible member are integral with respect to each other.

18. A hearing device comprising:

an earpiece having a first end and a second end, wherein the first end of the earpiece is configured for insertion into an ear canal of a user, and wherein at least a part of the earpiece is configured for placement along a first bend of the ear canal;

wherein the earpiece comprises a flexible member, wherein at least a part of the flexible member is configured for placement along a second bend of the ear canal located between the first bend and an eardrum;

wherein the earpiece further comprises a housing, and a receiver located in the housing, and wherein the flexible member has a portion that is offset in the medial direction relative to the receiver, and wherein the part of the flexible member that is configured for placement along the second bend has a first surface configured to abut a first side of an ear-canal-wall at different longitudinal locations along the first side of the ear-canal-wall, wherein the part of the flexible member also has a second surface configured to abut a second side of the ear-canal-wall at different longitudinal locations along the second side of the ear-canal-wall opposite from the first side of the ear-canal-wall, the second surface of the part of the flexible member being opposite from the first surface of the part of the flexible member; and wherein the flexible member has another part that is between the first bend and the second bend when the earpiece is inserted into the ear canal, and wherein the other part of the flexible member is configured to abut against the ear-canal-wall.

19. The hearing device of claim 18, wherein the part and the other part of the flexible member forms a continuous surface.

20. The hearing device of claim 18, wherein the part and the other part of the flexible member are integral with respect to each other.

21. A hearing device comprising:

an earpiece having a first end and a second end, wherein the first end of the earpiece is configured for insertion into an ear canal of a user, and wherein at least a part of the earpiece is configured for placement along a first bend of the ear canal;

wherein the earpiece comprises a flexible member, wherein at least a part of the flexible member is configured for placement along a second bend of the ear canal located between the first bend and an ear-drum; and wherein the hearing device further comprises a receiver, wherein the flexible member has an end portion, and wherein the receiver is located between the end portion of the flexible member and the second end of the earpiece, and wherein the receiver is configured for placement outside a bony region associated with the ear canal, wherein the part of the flexible member that is configured for placement along the second bend of the ear canal is offset from the receiver in a medial direction, and wherein the part of the flexible member that is offset from the receiver in the medial direction has a first surface configured to abut a first side of an ear-canal-wall at different longitudinal locations along the first side of the ear-canal-wall, wherein the part of the flexible member also has a second surface configured to abut a second side of the ear-canal-wall at different longitudinal locations along the second side of the ear-canal-wall opposite from the first side of the ear-canal-wall, the second surface of the part of the flexible member being opposite from the first surface of the part of the flexible member; and wherein the hearing device further comprises a sound channel configured to transmit sound outputted from the receiver, wherein the part of the flexible member that is configured for placement along the second bend of the ear canal comprises a flexible material that defines at least a majority of a length of the sound channel.

22. The hearing device of claim 21, wherein the earpiece comprises a dome.

23. The hearing device of claim 22, wherein the dome is customized.

24. The hearing device of claim 21, wherein the flexible member is elastically deformable so that the flexible member can conform with a shape of the ear canal when the earpiece is inserted into the ear canal.

25. The hearing device of claim 21, wherein the flexible member has a customized shape that corresponds with a shape of the ear canal at the second bend.

26. A hearing device comprising:

an earpiece having a first end and a second end, wherein the first end of the earpiece is configured for insertion into an ear canal of a user, and wherein at least a part of the earpiece is configured for placement along a first bend of the ear canal;

wherein the earpiece comprises a flexible member, wherein at least a part of the flexible member is configured for placement along a second bend of the ear canal located between the first bend and an ear-drum; and wherein the hearing device further comprises a receiver, wherein the flexible member has an end portion, and wherein the receiver is located between the end portion of the flexible member and the second end of the earpiece, and wherein the receiver is configured for placement outside a bony region associated with the ear canal, wherein the part of the flexible member that is configured for placement along the second bend of the ear canal is offset from the receiver in a medial direction, and wherein the part of the flexible member that is offset from the receiver in the medial direction has a first surface configured to abut a first side of an ear-canal-wall at different longitudinal locations along the first side of the ear-canal-wall, wherein the part of the flexible member also has a second surface configured to abut a second side of the ear-canal-wall at different longitudinal locations along the second side of the ear-canal-wall opposite from the first side of the ear-canal-wall, the second surface of the part of the flexible member being opposite from the first surface of the part of the flexible member; and wherein the flexible member has another part that is located in the first bend when the earpiece is inserted into the ear canal, and wherein the other part of the flexible member is configured to abut against the ear-canal-wall.

27. The hearing device of claim 26, wherein the part and the other part of the flexible member forms a continuous surface.

28. The hearing device of claim 26, wherein the part and the other part of the flexible member are integral with respect to each other.

29. A hearing device comprising:

an earpiece having a first end and a second end, wherein the first end of the earpiece is configured for insertion into an ear canal of a user, and wherein at least a part of the earpiece is configured for placement along a first bend of the ear canal;

wherein the earpiece comprises a flexible member, wherein at least a part of the flexible member is configured for placement along a second bend of the ear canal located between the first bend and an ear-drum; and wherein the hearing device further comprises a receiver, wherein the flexible member has an end portion, and wherein the receiver is located between the end portion of the flexible member and the second end of the earpiece, and wherein the receiver is configured for placement outside a bony region associated with the ear canal, wherein the part of the flexible member that is configured for placement along the second bend of the ear canal is offset from the receiver in a medial direction, and wherein the part of the flexible member that is offset from the receiver in the medial direction has a first surface configured to abut a first side of an ear-canal-wall at different longitudinal locations along the first side of the ear-canal-wall, wherein the part of the flexible member also has a second surface configured to abut a second side of the ear-canal-wall at different longitudinal locations along the second side of the ear-canal-wall opposite from the first side of the ear-canal-wall, the second surface of the part of the flexible member being opposite from the first surface of the part of the flexible member; and wherein the part of the flexible member is configured to undergo compression in a direction that is perpendicular to a longitudinal axis of the flexible member at different positions along the longitudinal axis of the flexible member when the part of the flexible member is placed along the second bend of the ear canal.

30. A hearing device comprising:

an earpiece having a first end and a second end, wherein the first end of the earpiece is configured for insertion into an ear canal of a user, and wherein at least a part of the earpiece is configured for placement along a first bend of the ear canal;

wherein the earpiece comprises a flexible member, wherein at least a part of the flexible member is configured for placement along a second bend of the ear canal located between the first bend and an ear-drum;

wherein the earpiece further comprises a housing, and a receiver located in the housing, and wherein the flexible member has a portion that is offset in the medial direction relative to the receiver, and wherein the part of the flexible member that is configured for placement along the second bend has a first surface configured to abut a first side of an ear-canal-wall at different longitudinal locations along the first side of the ear-canal-wall, wherein the part of the flexible member also has a second surface configured to abut a second side of the ear-canal-wall at different longitudinal locations along the second side of the ear-canal-wall opposite from the first side of the ear-canal-wall, the second surface of the part of the flexible member being opposite from the first surface of the part of the flexible member; and wherein the flexible member has another part that is located in the first bend when the earpiece is inserted into the ear canal, and wherein the other part of the flexible member is configured to abut against the ear-canal-wall.

31. The hearing device of claim 30, wherein the part and the other part of the flexible member forms a continuous surface.

32. The hearing device of claim 30, wherein the part and the other part of the flexible member are integral with respect to each other.

33. A hearing device comprising:

an earpiece having a first end and a second end, wherein the first end of the earpiece is configured for insertion into an ear canal of a user, and wherein at least a part of the earpiece is configured for placement along a first bend of the ear canal;

wherein the earpiece comprises a flexible member, wherein at least a part of the flexible member is configured for placement along a second bend of the ear canal located between the first bend and an ear-drum;

wherein the earpiece further comprises a housing, and a receiver located in the housing, and wherein the flexible member has a portion that is offset in the medial direction relative to the receiver, and wherein the part of the flexible member that is configured for placement along the second bend has a first surface configured to abut a first side of an ear-canal-wall at different longitudinal locations along the first side of the ear-canal-wall, wherein the part of the flexible member also has a second surface configured to abut a second side of the ear-canal-wall at different longitudinal locations along the second side of the ear-canal-wall opposite from the first side of the ear-canal-wall, the second surface of the part of the flexible member being opposite from the first surface of the part of the flexible member; and wherein the part of the flexible member is configured to undergo compression in a direction that is perpendicular to a longitudinal axis of the flexible member at different positions along the longitudinal axis of the flexible member when the part of the flexible member is placed along the second bend of the ear canal.

34. The hearing device of claim 1, wherein the end portion of the flexible member comprises the first end of the earpiece.

* * * * *